US005253693A

United States Patent [19]

Marlatt et al.

[11] Patent Number: 5,253,693

[45] Date of Patent: Oct. 19, 1993

[54] HOLD AND RELEASE MECHANISM FOR A FIRE DOOR SPRING TENSION ADJUSTING WHEEL

[75] Inventors: Wayne G. Marlatt, North Brunswick; Wojciech K. Cader, Edison, both of N.J.

[73] Assignee: Atlas Roll-Lite Door Corp., Edison, N.J.

[21] Appl. No.: 953,482

[22] Filed: Sep. 29, 1992

[51] Int. Cl.[5] ..... E05F 15/20

[52] U.S. Cl. ..... 160/7; 160/9; 160/315

[58] Field of Search ..... 160/7, 1, 9, 133, 315, 160/302, 303, 304.1

[56] References Cited

U.S. PATENT DOCUMENTS

| | | | |
|---|---|---|---|
| 1,089,347 | 3/1914 | Rush . | |
| 1,118,033 | 11/1914 | McCloud . | |
| 1,204,738 | 11/1916 | Brunst et al. . | |
| 1,272,347 | 7/1918 | Brunst . | |
| 1,795,390 | 3/1931 | Graystone | 160/7 |
| 2,696,250 | 12/1954 | Michelman | 160/315 |
| 2,969,932 | 1/1961 | Becker | 242/107.7 |
| 4,147,197 | 4/1979 | Bailey et al. | 160/7 |
| 4,583,706 | 4/1986 | Whitehouse et al. | 248/251 |

*Primary Examiner*—David M. Purol

*Attorney, Agent, or Firm*—David L. Davis

[57] ABSTRACT

A hold and release mechanism for a fire door spring tension adjusting wheel includes a finger which is retractable when the adjusting wheel is rotated in a direction to increase the tension of the door spring but remains in engagement with a notch on the periphery of the adjusting wheel to prevent rotation of the adjusting wheel in the other direction as urged by the spring tension. The finger is held within a bore in a block which is pivotably mounted to the plate supporting the adjusting wheel. A toggle arrangement coupled to the holding chain and the block keeps the finger engaged in the notch. When tension on the holding chain is released, the block is allowed to pivot so that the finger disengages from the adjusting wheel, which is then allowed to rotate under the urging of the fire door spring. This arrangement permits an operator to adjust the spring tension without requiring that the tension applied by the holding chain be relieved.

13 Claims, 6 Drawing Sheets

HOLD AND RELEASE MECHANISM FOR A FIRE DOOR SPRING TENSION ADJUSTING WHEEL

BACKGROUND OF THE INVENTION

This invention relates to fire doors which utilize spring tension to effect their automatic closure in the event of a fire and, more particularly, to a hold and release mechanism for the spring tension adjusting wheel for such a door.

Modern building codes for certain types of buildings require the presence of fire doors. The fire doors are arranged to automatically close upon the sensing of a fire condition in the vicinity of the door, so as to prevent the fire from spreading. Conventionally, such doors are associated with stored mechanical energy, such as, for example, a pretensioned spring or a raised weight, which is releasable to effect closure of the door. A typical release mechanism includes a fusible link which melts in the presence of fire to allow portions of a holding chain, or cable, to separate in order to release the stored energy.

With such an arrangement, it is necessary to be able to adjust the spring tension when the door is installed. Accordingly, an operator accessible adjusting wheel is generally provided. This adjusting wheel is normally prevented from rotating by a locking mechanism coupled to the holding chain so that when tension is applied by the holding chain, the adjusting wheel is locked. However, when the fusible link melts and separates the holding chain, the mechanism frees the adjusting wheel for rotation to allow the stored spring tension to move the fire door. In the past, to adjust the spring tension, the operator would relieve the tension applied by the holding chain to the locking mechanism, turn the adjusting wheel in the direction opposite to that in which the adjusting wheel turns during closure of the fire door a sufficient number of turns to provide the appropriate spring tension, and then restore the tension applied by the holding chain to the locking mechanism. Typically, turning of the adjusting wheel was effected by means of a wrench gripping the hub of the adjusting wheel. Since it is common to utilize a large wrench to gain maximum mechanical advantage, such a wrench could typically not make a full rotation and would therefore have to be removed from the adjusting wheel hub, the adjusting wheel would have to be held from turning, and the wrench would have to be reoriented and replaced on the adjusting hub. Such operation is very difficult and often requires that two operators be involved.

It is therefore a primary object of the present invention to provide a hold and release mechanism for a fire door spring tension adjusting wheel which overcomes the disadvantages of the conventional prior art locking mechanisms.

It is another object of the present invention to provide such a mechanism wherein the spring tension may be adjusted via the adjusting wheel without requiring that the holding chain tension be released.

It is a further object of this invention to provide such a mechanism which is designed so that a single operator can easily adjust the spring tension.

SUMMARY OF THE INVENTION

The foregoing, and additional, objects are attained in accordance with the principles of this invention in combination with a door coupled to adjustable spring means for providing releasable mechanical energy to assist in closing the door. The spring means has an adjusting wheel supported for rotation on a plate. The adjusting wheel is rotatable in a first direction to increase the tension of the spring means and is formed along its periphery with at least one notch which is used to lock the adjusting wheel against rotation. The present invention provides an arrangement for allowing rotation of the adjusting wheel in the first direction and for selectively preventing rotation of the adjusting wheel in a second direction opposite to the first direction. The arrangement comprises an interference finger having at a first end a first surface for engagement with the side of the notch which trails when the adjusting wheel rotates in the second direction, means for holding the finger, and means for mounting the holding means to the plate for pivoting movement about a pivot point. The holding means includes means for allowing the finger to partake of reciprocatory motion along a linear path toward and away from the pivot point and means for yieldably biasing the finger along the linear path away from the pivot point. The arrangement further includes support means for releasably supporting the holding means so that the finger extends into the notch and engages the side of the notch to prevent the adjusting wheel from rotating in the second direction, and release means effective for allowing the support means to release the holding means so that the holding means can pivot about the pivot point and move the finger out of engagement with the side of the notch to allow the adjusting wheel to rotate in the second direction.

In accordance with an aspect of this invention, the holding means includes a block having a longitudinal bore adapted to receive the finger therein. The bore has a central axis passing through the pivot point and defining the linear path of movement of the finger.

In accordance with another aspect of this invention, the bore extends into the block from a first end thereof and terminates short of the pivot point, and the biasing means includes a spring within the bore.

In accordance with yet another aspect of this invention, the support means includes a first member pivotably mounted to the plate and a second member pivotably mounted at a first end to the first member and pivotably mounted at a second end to the holding means, and the release means includes a third member fixedly secured to the first member and adapted for preventing the first member from rotating when the third member is held in a predetermined position, and means for selectively allowing the third member to move out of the predetermined position so that the first and second members are free to pivot, thereby releasing the holding means.

More specifically, the present invention provides an arrangement for releasably securing the spring tension adjusting wheel of a rolling fire door to allow the spring tension of the door to be set without requiring removal of the fire responsive holding chain. The adjusting wheel is supported for rotation on a plate, is formed along its periphery with a plurality of angularly spaced notches, and is rotatable in a first direction to increase the spring tension. The inventive arrangement comprises a block mounted to the plate for pivoting movement about a pivot point, the block being formed with a bore having a central axis passing through the pivot point, the bore extending into the block from a first end of the block remote from the pivot point and terminating short of the pivot point. A spring is disposed in the bore of the block and a finger member is disposed for sliding motion in the bore of the block, the finger member having a first end extending out of the block and a second end contacting the spring. The first end of the finger member is formed with a first surface adapted for engagement with the side of an adjusting wheel notch which trails when the adjusting wheel rotates in a second direction opposite to the first direction, rotation of the adjusting wheel in the first direction causing the finger member to slide into the block against the yielding force of the spring and out of engagement with the side of the notch. The arrangement further includes toggle means coupled to the holding chain, the toggle means being responsive to tension applied by the holding chain for preventing pivoting of the block so that the finger member first surface engages the adjusting wheel notch side to restrain the adjusting wheel from rotating in the second direction while allowing the adjusting wheel to rotate in the first direction. The toggle means is responsive to loss of the holding chain tension for allowing the block to pivot and move the finger member first surface out of engagement with the notch side so that the adjusting wheel is free to rotate in the second direction.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
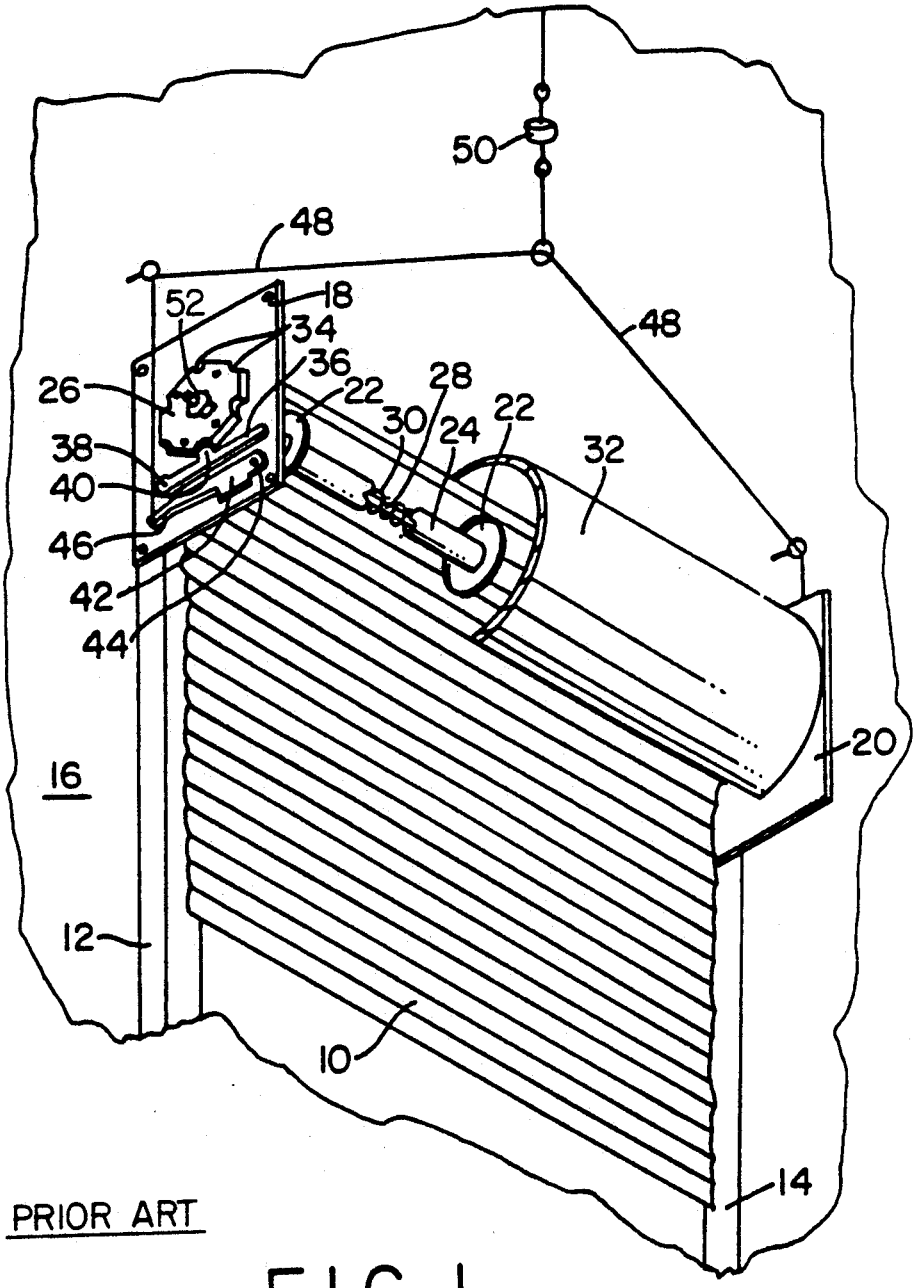
PRIOR ART FIG. 1
FIG. 1 is a perspective view, partially broken away, showing a prior art fire door of the type to which this invention pertains.

FIG. 1 shows a prior art fire door of the type manufactured and sold by Atlas Roll-Lite Door Corporation of Edison, N.J., with which the present invention finds utility. As shown in FIG. 1, the fire door 10 is guided by the vertical guide angles 12 and 14 which flank an opening selectively covered by the fire door 10. The guide angles 12, 14 are bolted to the wall 16 and have attached at their upper ends the bracket plates 18 and 20, respectively.

The door 10, which is comprised of a plurality of interlocked horizontal segments, is attached at its upper end to a plurality of rings 22 which are mounted to the hollow pipe shaft 24. By rotating the pipe shaft 24, the door 10 may be selectively raised or lowered. Within the pipe shaft 24 is a relatively short inner rod (not shown) extending through the plate 18 and pinned at one end to the adjusting wheel 26 and a relatively long inner rod 28 fixedly secured to the pipe shaft 24. A helical tension spring 30 surrounding the rod 28 has one end connected to the short inner rod and its other end connected to the long inner rod 28. It is understood that the inner rod 28 may be eliminated and the spring 30 may be connected directly to the pipe shaft 24. This assembly is preferably hidden from view by a cover 32 which extends between the bracket plates 18 and 20.

The spring 30 is utilized to store mechanical energy to assist in closing the door 10. Specifically, when the door 10 is in its fully open (raised) position, the spring 30 is placed under tension by turning the adjusting wheel 26, which is supported for rotation on the plate 18 by a bearing (not shown) surrounding the short inner rod which extends through the plate. The adjusting wheel 26 normally does not move. It is kept from moving by providing a plurality of notches 34 on its periphery. According to the prior art design, a holding bar 36 pivoted at 38 has a projection 40 which engages a notch 34 to prevent the adjusting wheel 26 from moving. The holding bar 36 is held in position by a weight bar 42 pivoted at 44. The end 46 of the weight bar 42 opposite the pivot point 44 is connected to a holding chain, or cable, 48 which, under normal conditions, prevents the weight bar 42 from dropping. If, however, the chain 48 is released, due to melting of the fusible link 50, the weight bar 42 is allowed to drop and the holding bar 36 disengages from the adjusting wheel 26. The tension in the spring 30 then causes the adjusting wheel 26 and the short inner rod (not shown) to spin. A kicker mechanism (not shown) between the short inner rod and the pipe shaft 24 imparts energy to the pipe shaft 24 which starts the door 10 closing, which closing is aided by gravity.

Although the drawings show a fusible link 50 for releasing the holding chain 48, it is understood that other arrangements for releasing the holding chain 48 may also be utilized. For example, an electro-mechanical fire detector such as the Fire Scout TM manufactured and sold by Atlas Roll-Lite Door Corporation of Edison, N.J., may be installed to selectively hold the chain 48 until a fire is detected.

In order to adjust the tension of the spring 30, an operator grips the hub 52 of the adjusting wheel 26 with a wrench and, while holding onto the wrench to prevent the adjusting wheel 26 from turning, either releases the tension on the chain 48 or uncouples the weight bar 42 from the chain 48 so that the projection 40 of the holding bar 36 is disengaged from the notch 34. The adjusting wheel 26 is then caused to rotate clockwise by means of the wrench. When the wrench must be repositioned on the hub 52, typically due to interference with the wall 16, the holding bar 36 is moved so that its projection 40 engages a notch 34 to restrain the adjusting wheel 26 from rotation due to the effects of tension of the spring 30. The operator then reorients the wrench and regrips the hub 52. The holding bar 36 is moved out of engagement with the adjusting wheel 26 and the adjusting wheel 26 is again rotated clockwise. This operation is then repeated until the spring 30 is suitably tensioned. It is apparent that this is a complicated procedure which a single operator may not be able to perform.

Figure 2:
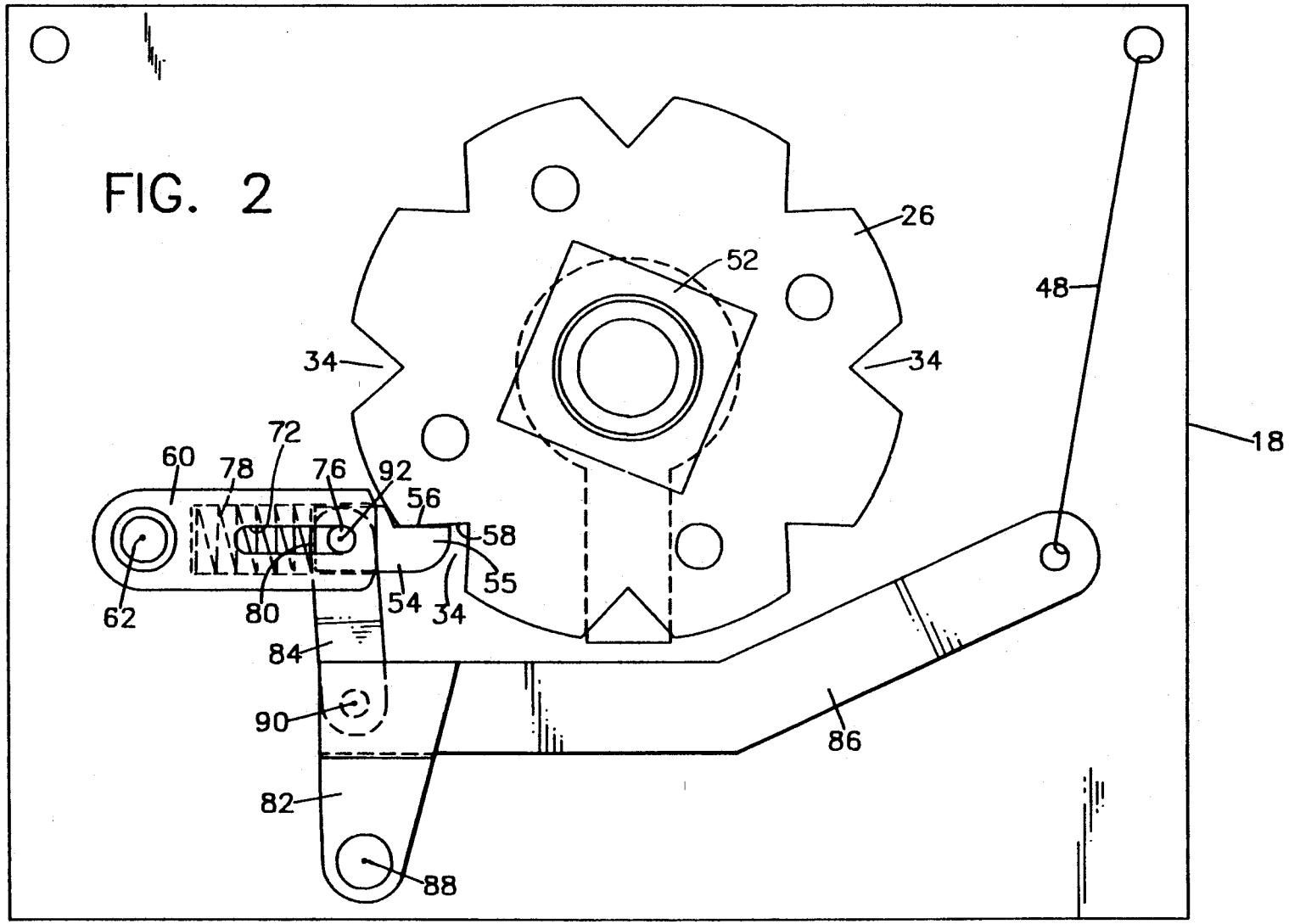
FIG. 2 is a side view of the adjusting wheel along with the hold and release mechanism according to the present invention with tension applied to the holding chain so that the spring tension of the door is maintained.
Figure 4A:
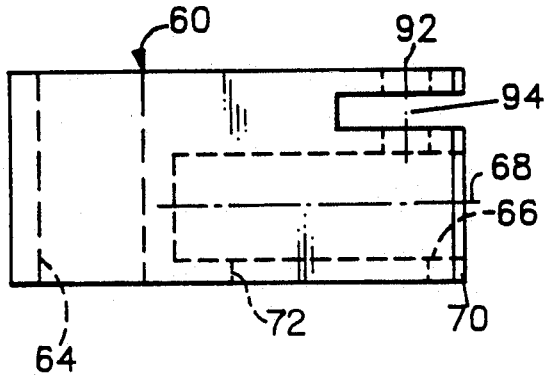
FIGS. 4A, 4B and 4C are top, side and end views, respectively, of the holding block of the inventive arrangement.
Figure 4B:
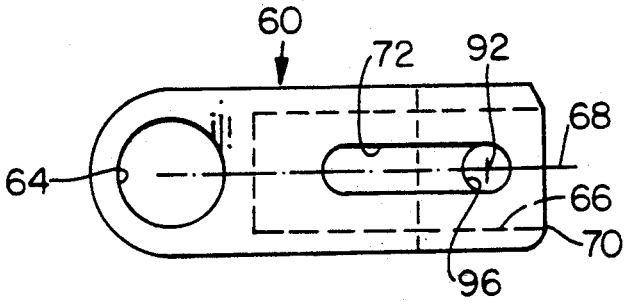

Referring to FIG. 2, in order to increase the fire door spring tension, the adjusting wheel 26 is rotated clockwise. Closure of the fire door is effected by allowing the adjusting wheel 26 to rotate counterclockwise. The improved hold and release mechanism according to this invention includes a finger 54 formed at a first end 55 with a first surface 56 which is designed to engage the side 58 of a notch 34. The side 58 is the side of each of the notches 34 which trails when the adjusting wheel 26 rotates counterclockwise. The inventive mechanism also includes a block 60 which holds the finger 54. The block 60 is mounted to the plate 18 for pivoting movement about a pivot point 62. Such mounting is provided in a conventional manner by forming the block 60 with a transverse bore 64 (see FIGS. 4A and 4B) having an axis colinear with the desired pivot axis and providing a stud extending through the transverse bore 64 and threaded into the plate 18.

The block 60 is further formed with a longitudinal bore 66 (see FIGS. 4A, 4B and 4C) having a central axis 68 which passes through the pivot point 62. The bore 66 extends into the block 60 from a first end 70 of the block 60 and terminates short of the pivot point 62, as well as being short of the transverse bore 64. The block 60 is further formed with an elongated slot 72 which has a longitudinal axis parallel to the central axis 68 of the bore 66. The slot 72 communicates with the bore 66.

Figure 4C:
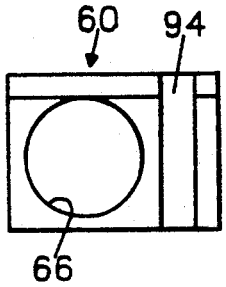
Figure 5A:
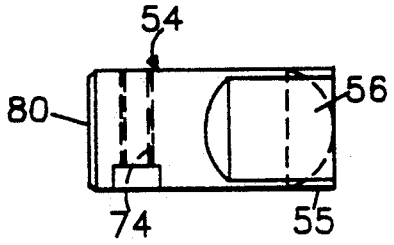
FIGS. 5A, 5B and 5C are top, side and end views, respectively, of the holding finger of the inventive arrangement.
Figure 5B:
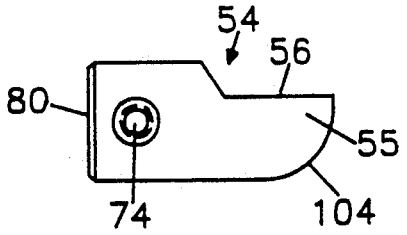
Figure 5C:
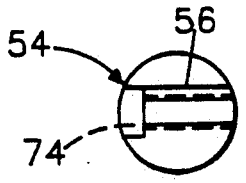

As best seen in FIG. 4C, the bore 66 is circular in transverse cross section and as best seen in FIG. 5C, the finger 54 is circular in transverse cross section. The finger 54 and the bore 66 are sized so that the finger 54 is slidable within the bore 66. Accordingly, the finger 54 can partake of reciprocatory motion along a linear path, defined by the central axis 68, toward and away from the pivot point 62. The finger 54 is formed with a transverse internally threaded bore 74 and a pin 76 extends through the elongated slot 72 and is threaded into the bore 74. The combined effect of the slot 72 and the pin 76 is to define a range of reciprocatory motion of the finger 54 and also to prevent rotation of the finger 54 about the central axis 68. For reasons to be discussed hereinafter, the pin 76 extends through the slot 72 so as to be accessible from outside the block 60. There is further provided a spring 78 which is disposed between the second end 80 of the finger 54 and the inner end of the bore 66. The spring 78 functions to yieldably bias the finger 54 outwardly of the block 60 away from the pivot point 62.

To effect the selective locking of the adjusting wheel 26, there is provided a toggle arrangement which includes a first link 82, a second link 84, and a third link 86. The link 82 is pivotably mounted to the plate 18 about a pivot point 88 and the link 84 is pivotably mounted at a first end to the link 82 about a pivot point 90 and pivotably mounted at a second end to the block 60 about a pivot point 92. As is clear from FIG. 4A, the block 60 is formed with a slot 94 which accepts the link 84 therein and a transverse bore 96 centered about the pivot axis 92 for accepting a dowel or the like to pivotably mount the link 84 to the block 60. The link 86 is fixedly secured at a first end to the link 82 and at its second end is coupled to the holding chain 48.

As is clear from FIG. 2, when the chain 48 applies tension to the link 86, the link 86 and the link 82 which is secured thereto are pulled counterclockwise about the pivot point 88. This moves the lower end of the link 84 upwardly and toward the left, forcing the block 60 counterclockwise about the pivot point 62. Thus, the surface 56 of the finger 54 is maintained in interfering engagement with the side 58 of the notch 34 of the adjusting wheel 26. So long as there is tension applied by the holding chain 48, this interfering engagement prevents the adjusting wheel 26 from rotating counterclockwise, thereby maintaining stored energy within the spring 30.

Figure 3:
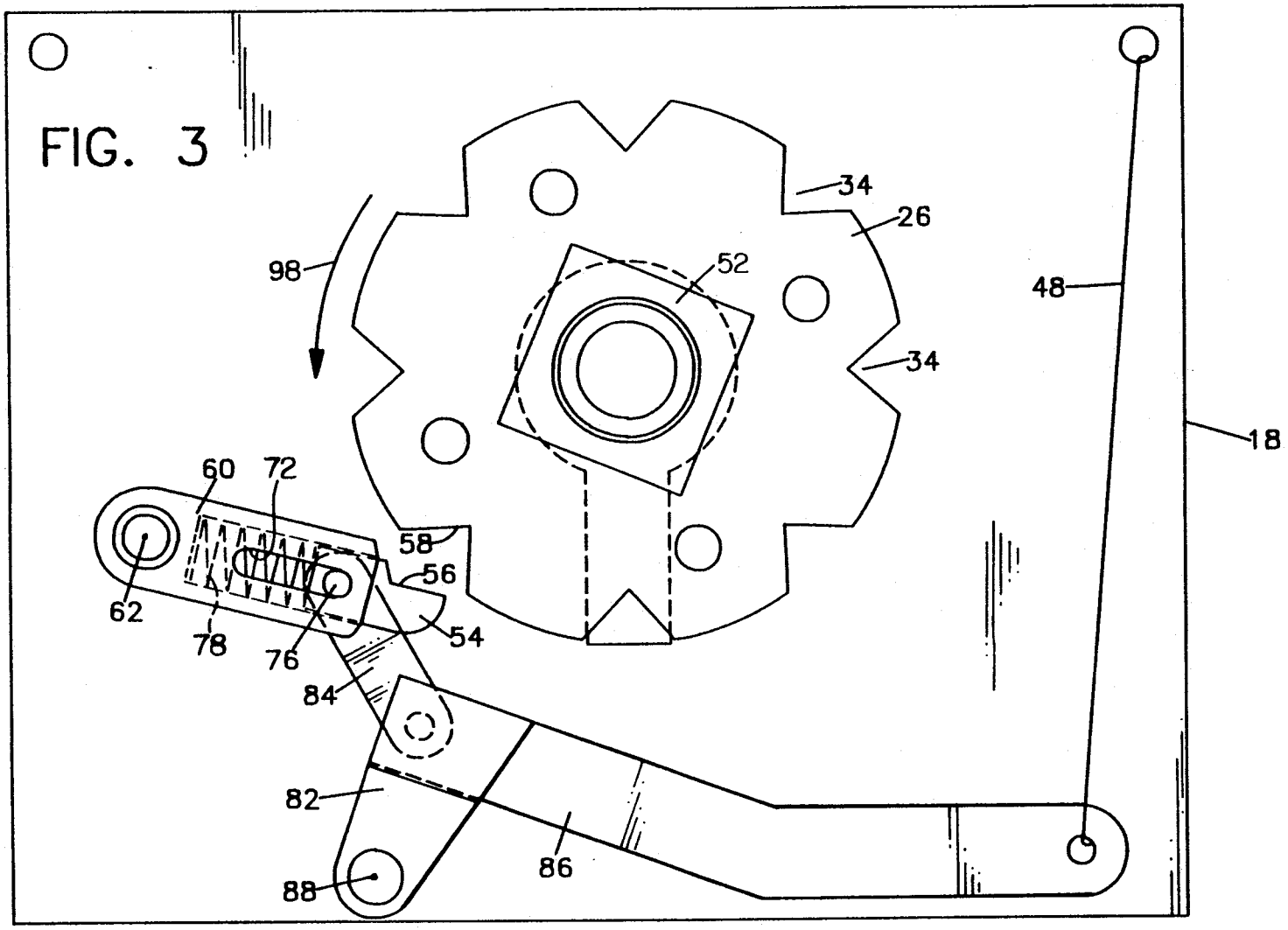
FIG. 3 is a view similar to FIG. 2 wherein the holding chain tension has been relieved so that the adjusting wheel is free to rotate and allow the fire door to close.

FIG. 3 illustrates the condition when tension on the holding chain is relieved, for example, due to the melting of the fusible link 50 or a release by some other device such as the Fire Scout TM. Upon elimination of the tension on the holding chain 48, the link 86 together with the link 82 are allowed to pivot clockwise about the pivot point 88. This allows the link 84 to move downwardly and to the right, thereby allowing the block 60 to pivot clockwise about the pivot point 62. Such movement takes the surface 56 of the finger 54 out of interfering engagement with the side 58 of the notch 34, thereby allowing the adjusting wheel 26 to rotate counterclockwise, as illustrated by the arrow 98, due to a force provided thereon by the spring 30. This force from the spring 30 also aids in moving the block 60 and the toggle arrangement 82, 84, 86 out of their interfering orientations.

Figure 6:
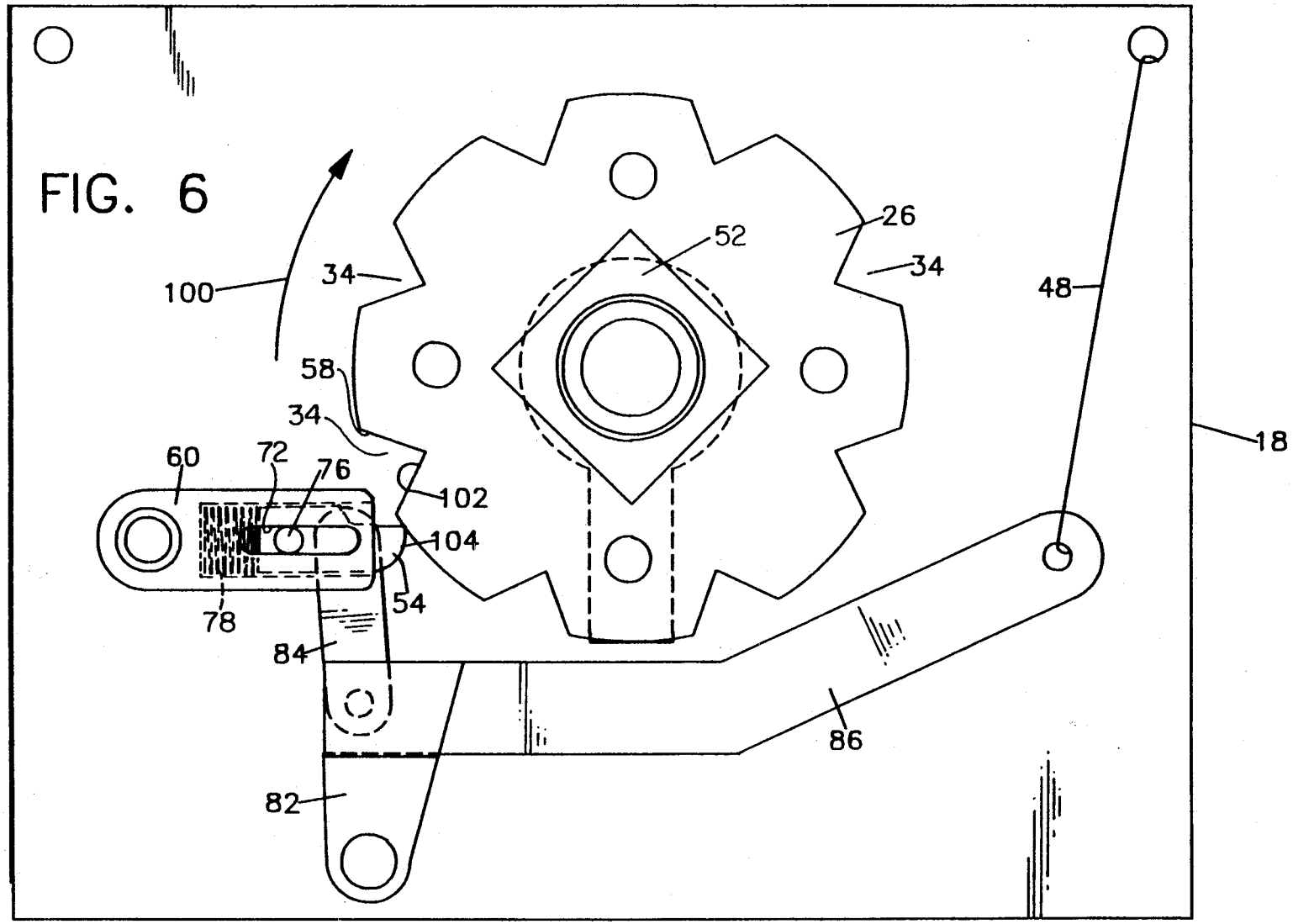
FIG. 6 is a view similar to FIG. 2 showing rotation of the adjusting wheel in a direction to increase the spring tension.

As previously discussed, the inventive arrangement allows for movement of the adjusting wheel 26 in a clockwise direction to set the tension on the spring 30 without requiring that the tension on the holding chain 48 be relieved. FIG. 6 illustrates how this operation is effected. Thus, when an operator wishes to increase the tension of the spring 30, the hub 52 of the adjusting wheel 26 is gripped by a wrench and the adjusting wheel 26 is turned clockwise, in the direction indicated by the arrow 100. This causes the other side 102 of the notch 34 to bear against the curved surface 104 of the finger 54. Pressure applied to that curved surface 104 causes the finger 54 to retract within the bore 66 of the block 60 against the biasing force of the spring 78. Thus, the adjusting wheel 26 can be rotated clockwise without requiring that the toggle arrangement 82, 84, 86 or the block 60 be moved. As the adjusting wheel 26 is turned and the next notch 34 along its periphery reaches the finger 54, the finger 54 extends into that notch, but as the side 102 of that next notch 34 engages the curved surface 104 of the finger 54, the finger 54 is again retracted into the bore 66. When the operator needs to reorient the wrench, all that need be done is insure that the finger 54 extends into one of the notches 34 so that the adjusting wheel 26 cannot rotate counterclockwise. It is therefore seen that with the mechanism according to the present invention, the tension of the spring 30 may be increased by a single operator using only one hand, a great improvement over the prior art designs.

It was previously mentioned that the pin 76 secured to the finger 54 extends through the slot 72 so as to be accessible from outside the block 60. The reason for this is that in the event that it is desired to decrease the tension of the spring 30, the operator can grip the hub 52 of the adjusting wheel 26 with a wrench, manually retract the finger 54 by means of the pin 76, and rotate the adjusting wheel 26 counterclockwise to reduce the tension of the spring 30. When the tension has been sufficiently reduced, the finger 54 is allowed to extend into an appropriate one of the notches 34 to prevent any further counterclockwise rotation of the adjusting wheel 26.

Accordingly, there has been disclosed an improved hold and release mechanism for the spring tension adjusting wheel of a spring loaded fire door. While an exemplary embodiment has been disclosed herein, it will be appreciated by those skilled in the art that various modifications and adaptations to the disclosed embodiment may be made and it is only intended that this invention be limited by the scope of the appended claims.

We claim:

1. In combination with a door coupled to adjustable spring means for providing releasable mechanical energy to assist in closing the door, the spring means having an adjusting wheel supported for rotation on a plate, the adjusting wheel being rotatable in a first direction to increase the tension of the spring means and being formed along its periphery with at least one notch, an arrangement for allowing rotation of said adjusting wheel in said first direction and for selectively preventing rotation of said adjusting wheel in a second direction opposite to said first direction, the arrangement comprising:

an interference finger having at a first end a first surface for engagement with the side of said at least one notch which trails when said adjusting wheel rotates in said second direction;

means for holding said finger;

means for mounting said holding means to said plate for pivoting movement about a pivot point;

said holding means including means for allowing said finger to partake of reciprocatory motion along a linear path toward and away from said pivot point and means for yieldably biasing said finger along said linear path away from said pivot point;

support means for releasably supporting said holding means so that said finger extends into said at least one notch and engages said side of said at least one notch to prevent said adjusting wheel from rotating in said second direction; and release means effective for allowing said support means to release said holding means so that said holding means can pivot about said pivot point and move said finger out of engagement with said side of said at least one notch to allow said adjusting wheel to rotate in said second direction.

2. The arrangement according to claim 1 wherein said holding means includes a block having a longitudinal bore adapted to receive said finger therein, said bore having a central axis passing through said pivot point and defining said linear path.

3. The arrangement according to claim 2 wherein said bore extends into said block from a first end thereof and terminates short of said pivot point, and said biasing means includes a spring within said bore.

4. The arrangement according to claim 3 wherein said holding means includes means for defining the range of reciprocatory motion of said finger and means for preventing rotation of said finger about said central axis.

5. The arrangement according to claim 4 wherein said block is formed with an elongated slot having a longitudinal axis parallel to said central axis and said holding means includes a pin member secured to said finger and extending into said slot.

6. The arrangement according to claim 5 wherein said pin member extends through said slot so as to be accessible from outside said block.

7. The arrangement according to claim 1 wherein:

said support means includes:

a first member pivotably mounted to said plate; and a second member pivotably mounted at a first end to said first member and pivotably mounted at a second end to said holding means; and said release means includes:

a third member fixedly secured to said first member and adapted for preventing said first member from rotating when said third member is held in a predetermined position; and means for selectively allowing said third member to move out of said predetermined position so that said first and second members are free to pivot, thereby releasing said holding means.

8. The arrangement according to claim 7 wherein said third member is elongated and is secured to said first member at a first end and said release means includes means for releasably holding the second end of said third member so that said third member is in said predetermined position.

9. The arrangement according to claim 8 wherein the means for releasably holding the second end of said third member includes chain means having a fusible link.

10. In combination with a rolling fire door having spring means for applying spring tension to the door in a direction to close the door, a fire responsive holding chain coupled to the spring means for maintaining the spring tension on the door in the absence of a fire condition and releasing the spring tension to close the door upon the occurrence of a fire condition, and a spring tension adjusting wheel coupled to the spring means and rotatable to adjust the spring tension applied by the spring means to the door, an arrangement for releasably securing the spring tension adjusting wheel to allow the spring tension of the door to be set without requiring removal of the fire responsive holding chain, the adjusting wheel being supported for rotation on a plate and formed along its periphery with a plurality of angularly spaced notches, the adjusting wheel being rotatable in a first direction to increase the spring tension, the arrangement comprising:

a block mounted to said plate for pivoting movement about a pivot point, said block being formed with a bore having a central axis passing through said pivot point, said bore extending into said block from a first end of said block remote from said pivot point and terminating short of said pivot point;

a spring disposed in said bore of said block;

a finger member disposed for sliding motion in said bore of said block, said finger member having a first end extending out of said block and a second end contacting said spring, said first end of said finger member being formed with a first surface adapted for engagement with the side of an adjusting wheel notch which trails when the adjusting wheel rotates in a second direction opposite to said first direction, rotation of said adjusting wheel in said first direction causing said finger member to slide into said block against the yielding force of said spring and out of engagement with said side of said notch; and toggle means coupled to said holding chain, said toggle means being responsive to tension applied by said holding chain for preventing pivoting of said block so that said finger member first surface engages said adjusting wheel notch side to restrain said adjusting wheel from rotating in said second direction while allowing said adjusting wheel to rotate in said first direction, said toggle means being responsive to loss of said holding chain tension for allowing said block to pivot and move said finger member first surface out of engagement with said notch side so that said adjusting wheel is free to rotate in said second direction.

11. The arrangement according to claim 10 wherein said block is formed with an elongated slot parallel to said central axis, the arrangement further including a pin member secured to said finger member and extending into said slot.

12. The arrangement according to claim 11 wherein said pin member extends through said slot so as to be accessible from outside said block.

13. The arrangement according to claim 10 wherein said toggle means includes:

a first link pivotably mounted at a first end to said plate;

a second link pivotably mounted at a first end to the second end of said first link and pivotably mounted at a second end to said block at a point between said block first end and the pivot point of said block; and a third link secured at a first end to said first link and coupled at a second end to said holding chain;

wherein when tension is applied by said holding chain to said third link, said first and second links are maintained in a first position to prevent said block from pivoting, and when the tension on said holding chain is released, said first and second links pivot so that said block pivots to move said finger member out of engagement with said adjusting wheel notch side.

* * * * *